US010553996B2

(12) United States Patent
Yamanashi

(10) Patent No.: US 10,553,996 B2
(45) Date of Patent: Feb. 4, 2020

(54) FEMALE CONNECTOR AND FITTING CONNECTOR

(71) Applicant: Yazaki Corporation, Tokyo (JP)

(72) Inventor: Daisuke Yamanashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/399,994

(22) Filed: Apr. 30, 2019

(65) Prior Publication Data

US 2019/0348802 A1 Nov. 14, 2019

(30) Foreign Application Priority Data

May 14, 2018 (JP) ..... 2018-092791

(51) Int. Cl.

| | |
|---|---|
| ***H01R 24/38*** | (2011.01) |
| ***H01R 13/436*** | (2006.01) |
| ***H01R 13/627*** | (2006.01) |
| *H01R 13/11* | (2006.01) |
| *H01R 9/05* | (2006.01) |
| *H01R 4/18* | (2006.01) |
| *H01R 13/44* | (2006.01) |
| *H01R 103/00* | (2006.01) |

(52) U.S. Cl.

CPC ..... *H01R 24/38* (2013.01); *H01R 13/4361* (2013.01); *H01R 13/6271* (2013.01); *H01R 4/183* (2013.01); *H01R 9/05* (2013.01); *H01R 13/111* (2013.01); *H01R 13/44* (2013.01); *H01R 2103/00* (2013.01)

(58) Field of Classification Search

CPC ..... H01R 2103/00; H01R 13/44; H01R 9/05; H01R 24/38; H01R 13/111; H01R 4/183

USPC ..... 439/675, 578, 693, 843, 851, 680

See application file for complete search history.

(56) References Cited

U.S. PATENT DOCUMENTS 6,113,436 A * 9/2000 Kuwahara ..... H01R 13/44 439/693

9,490,567 B2 * 11/2016 Hirakawa ..... H01R 13/42

FOREIGN PATENT DOCUMENTS

JP 8-78079 A 3/1996

* cited by examiner

*Primary Examiner* — Abdullah A Riyami
*Assistant Examiner* — Justin M Kratt
(74) *Attorney, Agent, or Firm* — Kenealy Vaidya LLP

(57) ABSTRACT

A female connector includes a female terminal and a female side insulation member. The female terminal includes a tubular-shaped female side connection body having a female side space portion therein into which the male side connection body is fitted in an inserting manner on a same cylinder axis. The female side insulation member includes a finger touch prevention body inserted into a first space portion of the outer tubular body and a male side space portion of the male side connection body. The finger touch prevention body is projected more than a tip end surface of the female side connection body. An insulating annular body projected more than the tip end surface of the female side connection body on a same cylinder axis is provided outside the female side space portion in a direction orthogonal to a cylinder axis direction of the female side connection body.

5 Claims, 13 Drawing Sheets

FEMALE CONNECTOR AND FITTING CONNECTOR

CROSS-REFERENCE TO RELATED APPLICATION(S)

The present application claims priority to and incorporates by reference the entire contents of Japanese Patent Application No. 2018-092791 filed in Japan on May 14, 2018.

BACKGROUND OF THE INVENTION

1. Field of the Invention

The present invention relates to a female connector and a fitting connector.

2. Description of the Related Art

Conventionally, a fitting connector that includes a female connector provided with a female terminal and a male connector provided with a male terminal, and that physically and electrically connects the female terminal and the male terminal by fitting the female connector and the male connector with each other has been known. In the fitting connector, the female connector includes a tubular-shaped female terminal and a female side insulation member disposed inside the female terminal. The female side insulation member is provided so that a finger does not come into contact with the female terminal. For example, the female side insulation member is formed in a pillar shape. Moreover, in the fitting connector, the male connector includes a male terminal fitted inside the female terminal in an inserting manner, and a male side insulation member that covers the tip end surface of the male terminal. The male side insulation member is provided so that a finger does not come into contact with the tip end of the male terminal. A space portion into which the female side insulation member is inserted when the female connector and the male connector are fitted to each other, is formed in the male terminal and the male side insulation member. For example, the following Japanese Patent Application Laid-open No. 8-78079 discloses such a female connector and a fitting connector.

In the fitting connector, as a measure to deal with large current, the physical size of the female connector and the male connector may be increased in the radial direction. However, for example, in the female connector, when the physical size of the female terminal is increased in the radial direction, a gap between the female side insulation member and the female housing will be increased. Consequently, there is still room for improvement in ensuring the finger touch prevention function.

SUMMARY OF THE INVENTION

Thus, an object of the present invention is to provide a female connector and a fitting connector capable of ensuring the finger touch prevention function.

In order to solve the above mentioned problem and achieve the object, a female connector according to one aspect of the present invention includes a female terminal physically and electrically connected to a male terminal, including a tubular-shaped male side connection body, of a male connector that is provided with the male terminal and an insulating male side insulation member having a tubular-shaped outer tubular body covering a tip end surface of the male side connection body at a connector insertion direction side on a same cylinder axis; and an insulating female side insulation member, wherein the female terminal includes a tubular-shaped female side connection body having a female side space portion therein into which the male side connection body is fitted in an inserting manner on a same cylinder axis, the female side insulation member includes a pillar-shaped or tubular-shaped finger touch prevention body that is disposed in the female side space portion on a same axial line as that of a cylinder axis of the female side space portion, and that is inserted into a space portion inside the outer tubular body and a male side space portion inside the male side connection body, when the female side connection body and the male side connection body are fitted to each other in an inserting manner, the finger touch prevention body is projected more than a tip end surface of the female side connection body at a connector insertion direction side, in an axial direction, and an insulating annular body projected more than the tip end surface of the female side connection body on a same cylinder axis is provided outside the female side space portion in a direction orthogonal to a cylinder axis direction of the female side connection body.

According to another aspect of the present invention, in the female connector, it is preferable that the female connector includes a female housing formed with a tubular-shaped female side fitting part that houses the female terminal therein and that covers the female terminal from outside, wherein the annular body is provided on the female side fitting part.

According to still another aspect of the present invention, in the female connector, it is preferable that a tip end of the finger touch prevention body has an annular chamfer part at a connector insertion direction side over a circumferential direction.

In order to achieve the object, a fitting connector according to still another aspect of the present invention includes a female connector provided with a female terminal and an insulating female side insulation member; and a male connector provided with a male terminal and an insulating male side insulation member, wherein the female terminal includes a tubular-shaped female side connection body in which a female side space portion is formed, the male terminal includes a tubular-shaped male side connection body fitted to the female side space portion in an inserting manner on a same cylinder axis, the male side insulation member includes a tubular-shaped outer tubular body that covers a tip end surface of the male side connection body at a connector insertion direction side on a same cylinder axis, the female side insulation member includes a pillar-shaped or tubular-shaped finger touch prevention body that is disposed in the female side space portion on a same axial line as that of a cylinder axis of the female side space portion, and that is inserted into a space portion inside the outer tubular body and a male side space portion inside the male side connection body, when the female side connection body and the male side connection body are fitted to each other in an inserting manner, the finger touch prevention body is projected more than a tip end surface of the female side connection body at a connector insertion direction side, in an axial direction, and in the female connector, an insulating annular body projected more than the tip end surface of the female side connection body on a same cylinder axis is provided outside the female side space portion in a direction orthogonal to a cylinder axis direction of the female side connection body.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a fitting connector according to the present invention will be described in detail with reference to the drawings. It is to be understood that this invention is not limited to the embodiment.

Embodiment

An embodiment of a fitting connector according to the present invention will now be described with reference to FIG. 1 to FIG. 15.

Figure 1:
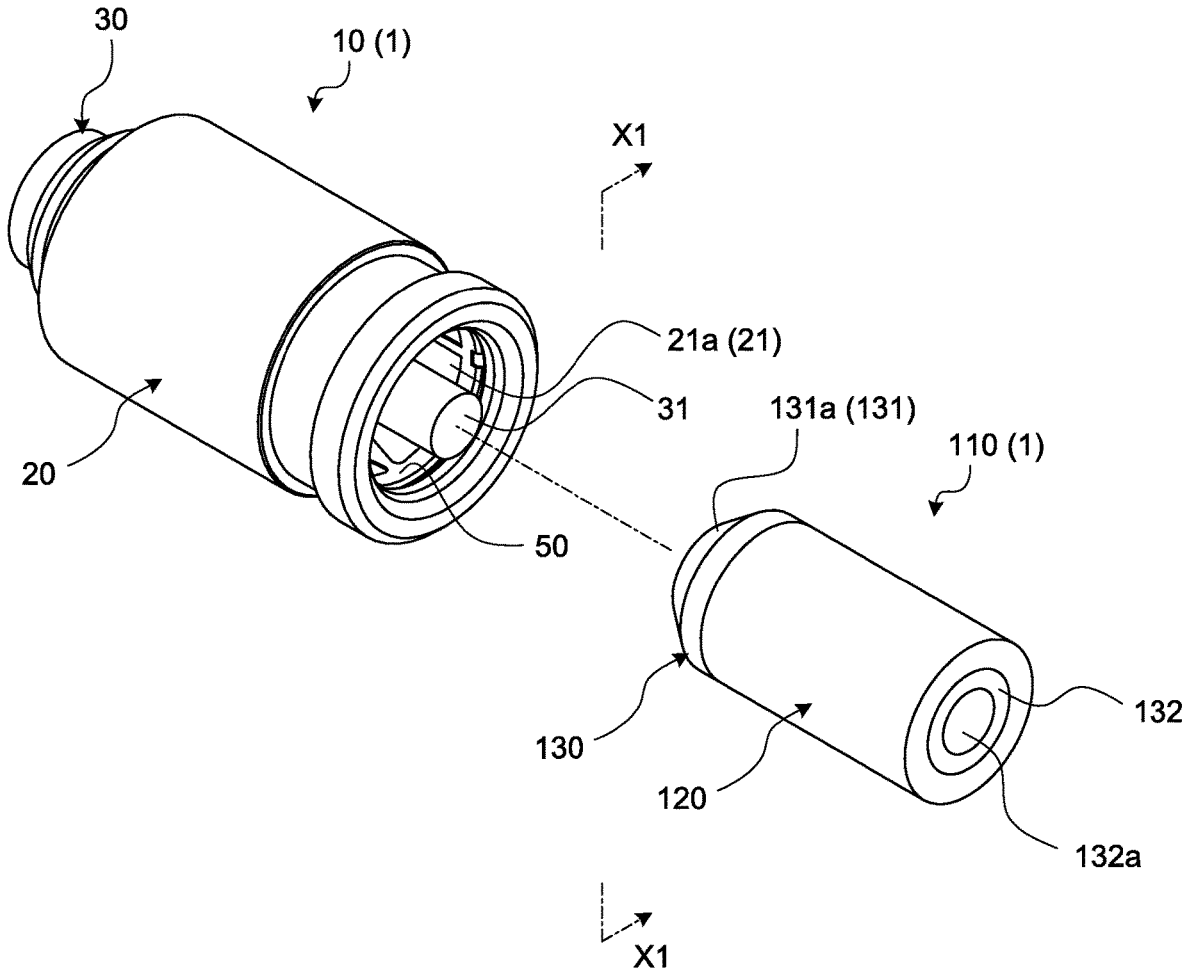
FIG. 1 is a perspective view illustrating a fitting connector in a state of being separated in an embodiment.
Figure 2:
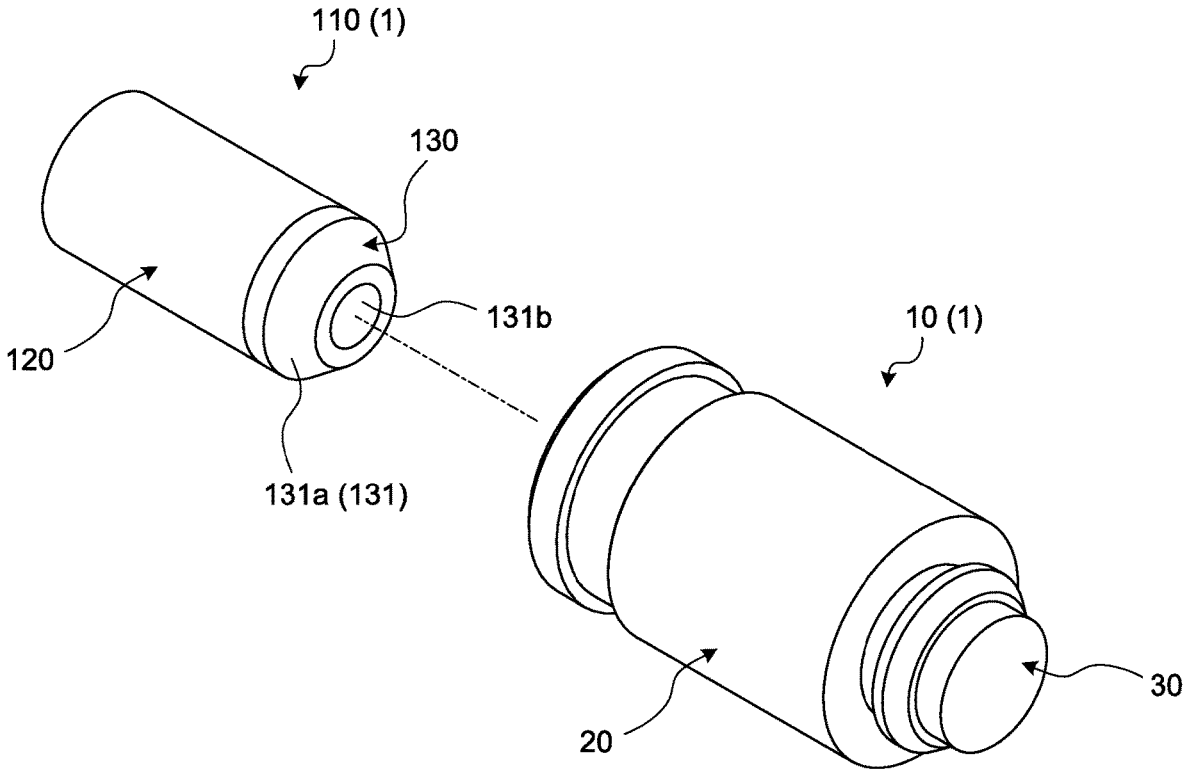
FIG. 2 is a perspective view of the fitting connector in a state of being separated in the embodiment viewed from another angle.
Figure 3:
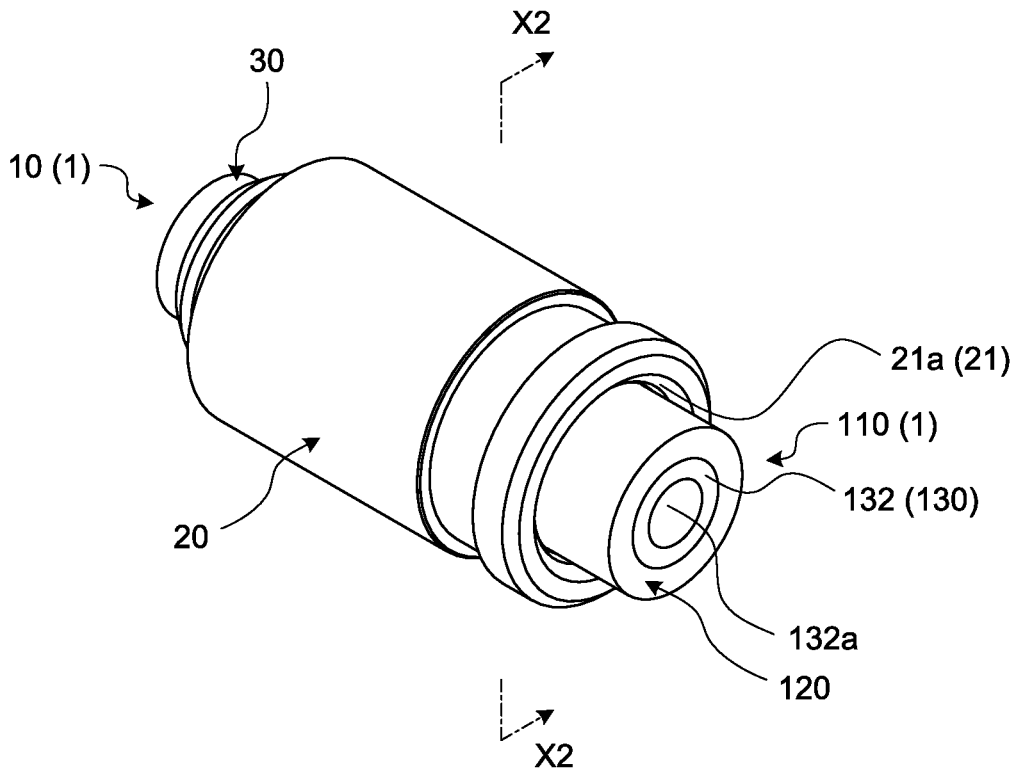
FIG. 3 is a perspective view illustrating a fitting connector in a state of being fitted in an inserting manner in the embodiment.

A reference numeral 1 in FIG. 1 to FIG. 3 illustrates a fitting connector of the present embodiment. The fitting connector 1 is what is called a female and male connector. The fitting connector 1 includes a female connector 10 (from FIG. 1 to FIG. 4) provided with a female terminal 20 and an insulating female side insulation member 30, and a male connector 110 (from FIG. 1 to FIG. 3, and FIG. 5) provided with a male terminal 120 and an insulating male side insulation member 130. In each of these drawings, a female housing 40 and a male housing 140, which will be described below, are omitted for convenience of explanation.

In the fitting connector 1, the female connector 10 and the male connector 110 are fitted to each other by an insertion operation. The female terminal 20 and the male terminal 120 are physically and electrically connected, by fitting the female terminal 20 and the male terminal 120 in an inserting manner, when the female connector 10 and the male connector 110 are fitted to each other in an inserting manner (FIG. 3). Alternatively, in the fitting connector 1, the female connector 10 and the male connector 110 are separated from each other by a separation operation. Consequently, the physical and electrical connection between the female terminal 20 and the male terminal 120 is eliminated (FIG. 1 and FIG. 2). The insertion/fitting direction and the separation direction are opposite to each other. In the following, the insertion/fitting direction is referred to as a "connector insertion direction", and the separation direction is referred to as a "connector separation direction". These directions are orientations of the connector, when the connector is inserted into or extracted from the counterpart connector of the connector.

First, the female connector 10 will be described.

Figure 6:
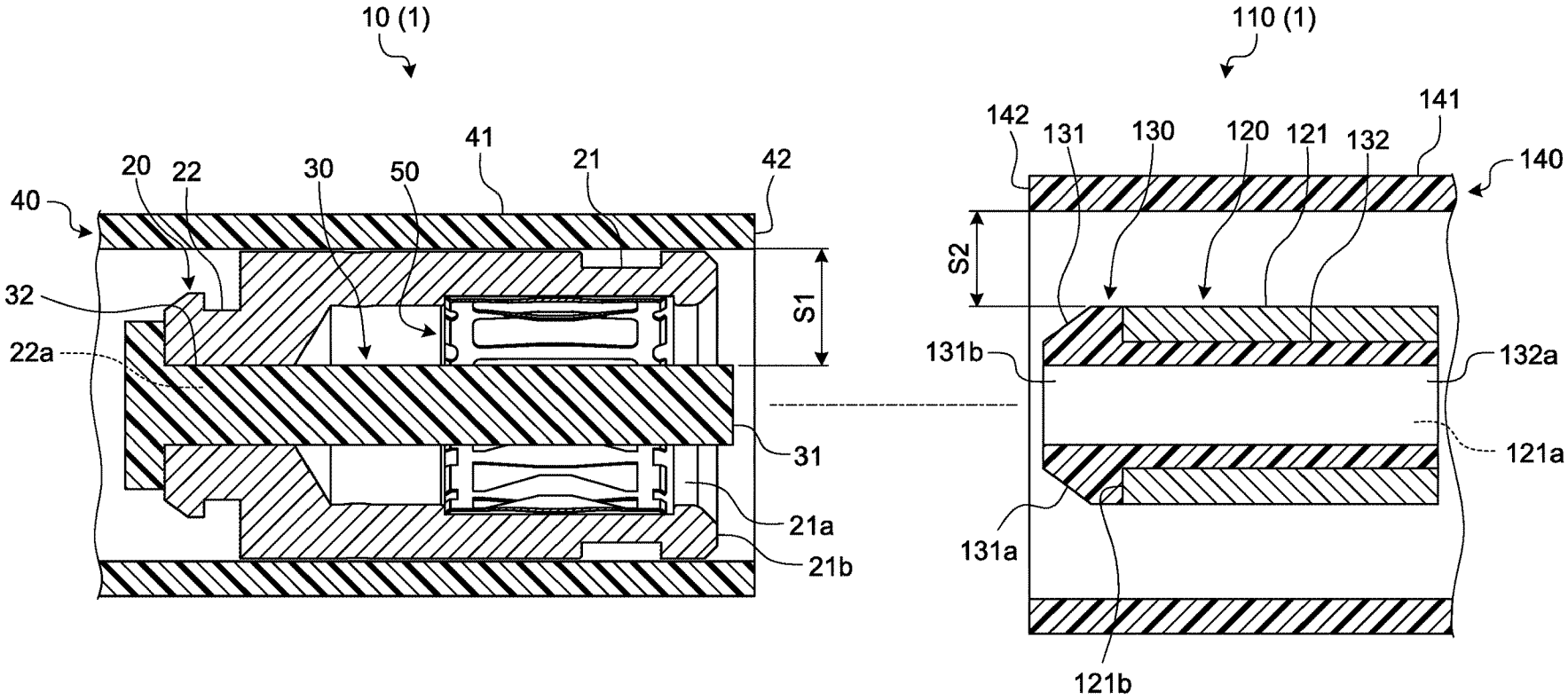
FIG. 6 is a sectional view cut along the line X1-X1 in FIG. 1.
Figure 7:
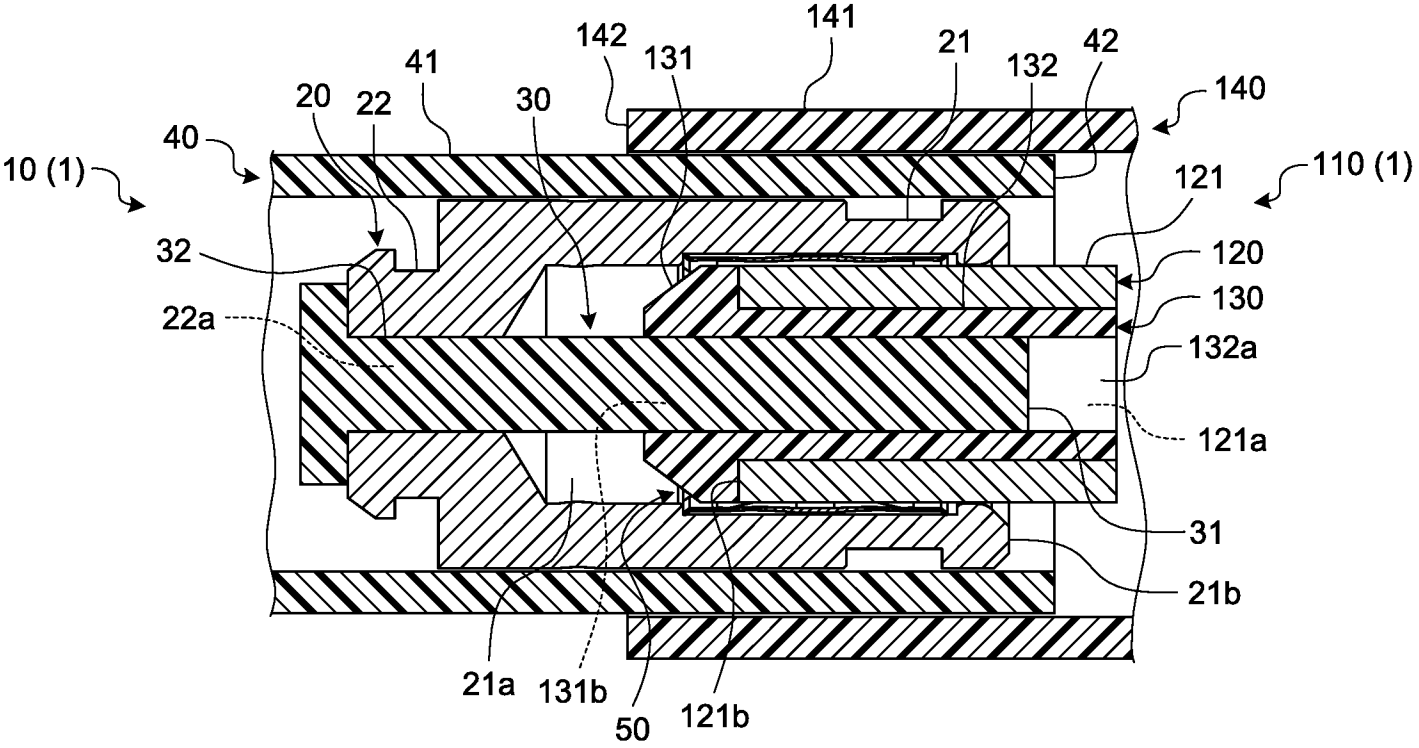
FIG. 7 is a sectional view cut along the line X2-X2 in FIG. 3.

In addition to the female terminal 20 and the female side insulation member 30, the female connector 10 includes the female housing 40 for housing the female terminal 20 and the female side insulation member 30 (FIG. 6 and FIG. 7).

The female terminal 20 is molded from a conductive material such as metal. The female terminal 20 includes a tubular-shaped female side connection body 21 in which a female side space portion 21*a* is formed (FIG. 2, FIG. 4, FIG. 6, and FIG. 7). Moreover, the female terminal 20 includes a tubular-shaped housing body 22 having a housing space portion 22*a* for housing and holding the female side insulation member 30 therein (FIG. 6 and FIG. 7). In the female terminal 20, the female side connection body 21 and the housing body 22 are arranged in parallel on the same cylinder axis. In this example, the female side connection body 21 and the housing body 22 are adjacent to each other on the same cylinder axis. In this example, the female side connection body 21 and the housing body 22 are each formed in a cylindrical shape.

A male side connection body 121, which will be described below, of the male terminal 120 is fitted to the female side space portion 21*a* of the female side connection body 21 in an inserting manner, on the same cylinder axis. The female terminal 20 and the male terminal 120 are physically and electrically connected by the female side connection body 21 and the male side connection body 121 that are fitted to each other in an inserting manner.

Figure 4:
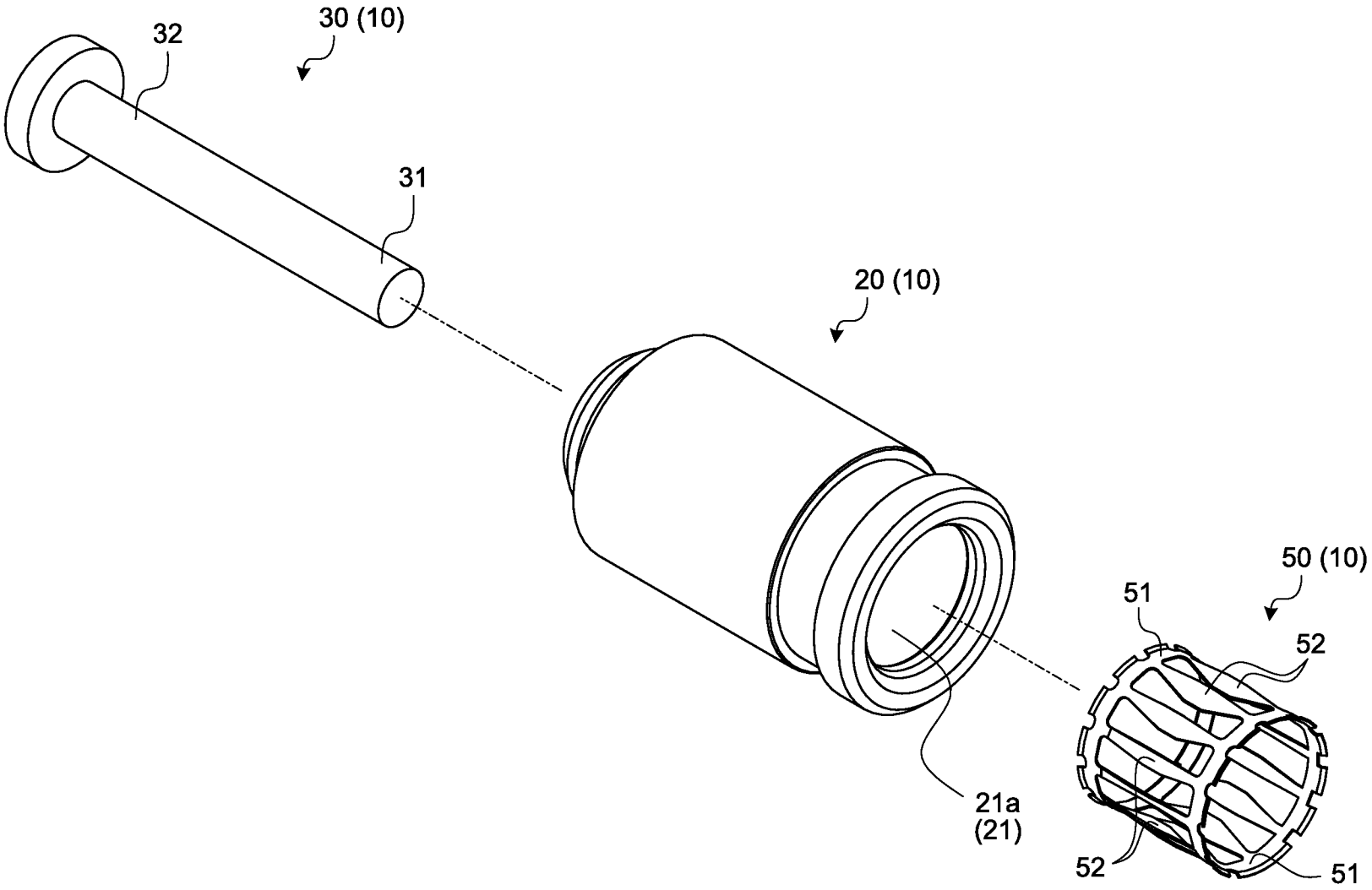
FIG. 4 is an exploded perspective view of a female connector.

In this example, a contact member 50 (FIG. 2, FIG. 4, FIG. 6, and FIG. 7) is interposed between the female side connection body 21 and the male side connection body 121. The female side connection body 21 and the male side connection body 121 are physically and electrically connected via the contact member 50. The contact member 50 includes two annular parts 51 disposed on the same axial line at an interval, and a plurality of contact parts 52 that connect the two annular parts 51 (FIG. 4). The contact member 50 is physically and electrically connected to the female side connection body 21, by holding the two annular parts 51 while bringing the two annular parts 51 into contact with the inner peripheral surface of the female side space portion 21*a*. The annular parts 51 in the example are each formed in a ring shape. The contact parts 52 are arranged around the axis. Each of the contact parts 52 has a spring property, and generates a resilient force, which is a reaction force, by being pressed by the inserted male side connection body 121. The contact member 50 is physically and electrically connected to the male side connection body 121, by using the spring property of each of the contact parts 52.

The female side insulation member 30 is molded from an insulation material such as synthetic resin. The female side insulation member 30 is a member for preventing a finger from coming into contact with the female terminal 20 along with the female housing 40. The female side insulation member 30 is housed in the female side space portion 21*a* and the housing space portion 22*a* in the female terminal 20. The female side insulation member 30 includes a pillar-shaped or tubular-shaped finger touch prevention body 31. The finger touch prevention body 31 is disposed in the female side space portion 21*a* on the same axial line as that of the cylinder axis of the female side space portion 21*a* (FIG. 2, FIG. 4, FIG. 6, and FIG. 7). Moreover, the female side insulation member 30 includes a pillar-shaped or tubular-shaped object to be housed 32. The object to be housed 32 is housed in the housing space portion 22*a* on the same axial line as that of the cylinder axis of the housing space portion 22*a* (FIG. 4, FIG. 6, and FIG. 7). In this example, the finger touch prevention body 31 and the object to be housed 32 are each formed in a columnar shape.

The outer diameter of the finger touch prevention body 31 is formed so as to be smaller than the inner diameter of the female side space portion 21*a*. Consequently, a tubular-shaped space is formed between the finger touch prevention body 31 and the inner peripheral surface of the female side space portion 21*a*. The male side connection body 121 is inserted into the tubular space. Thus, when the female side connection body 21 and the male side connection body 121 are fitted to each other in an inserting manner, the finger touch prevention body 31 is inserted into a male side space portion 121*a*, which will be described below, inside the male side connection body 121.

Figure 8:
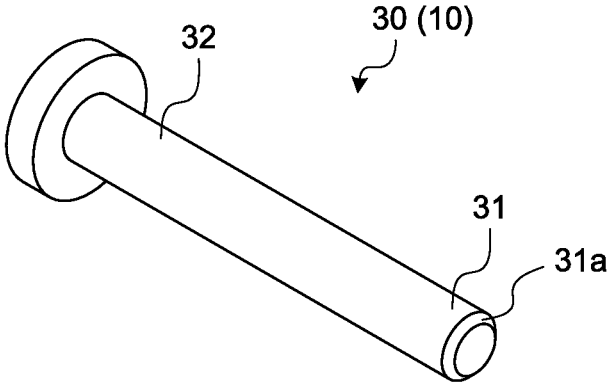
FIG. 8 is a perspective view illustrating a variation of a finger touch prevention body.
Figure 9:
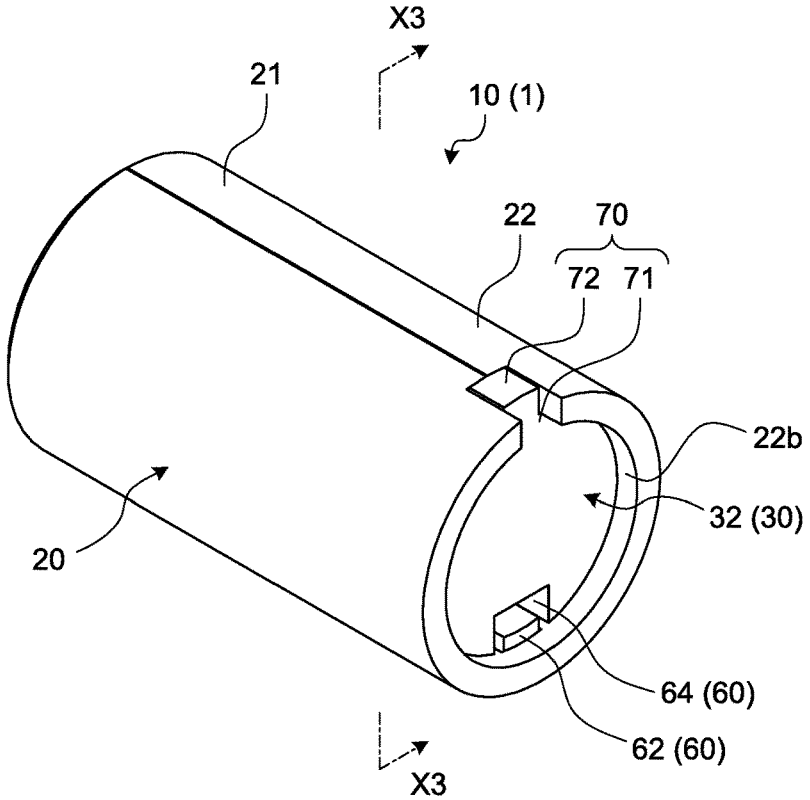
FIG. 9 is a perspective view illustrating a female connector provided with a fixing structure.
Figure 10:
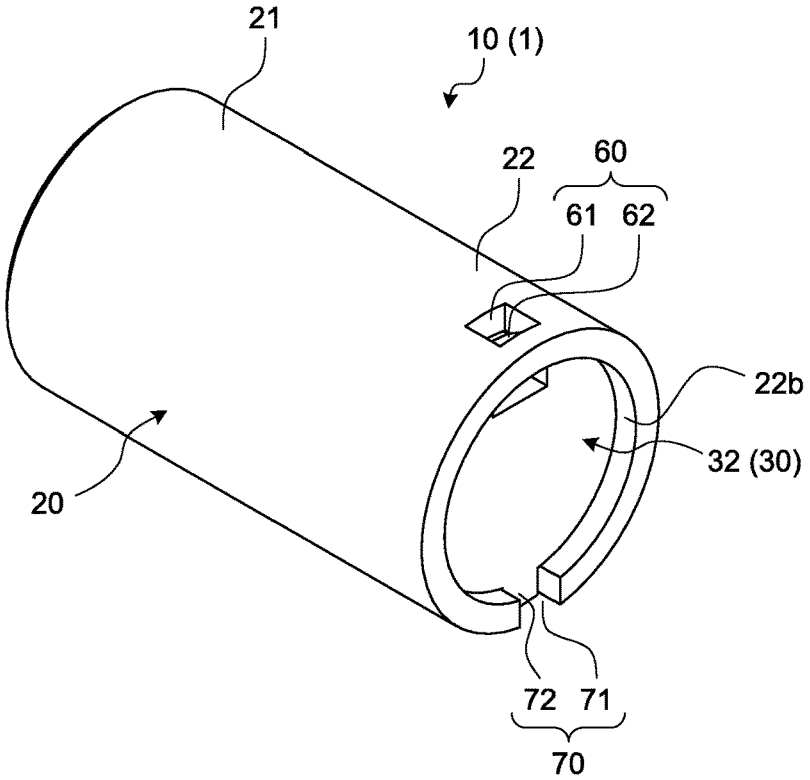
FIG. 10 is a perspective view of the female connector provided with the fixing structure viewed from another angle.
Figure 11:
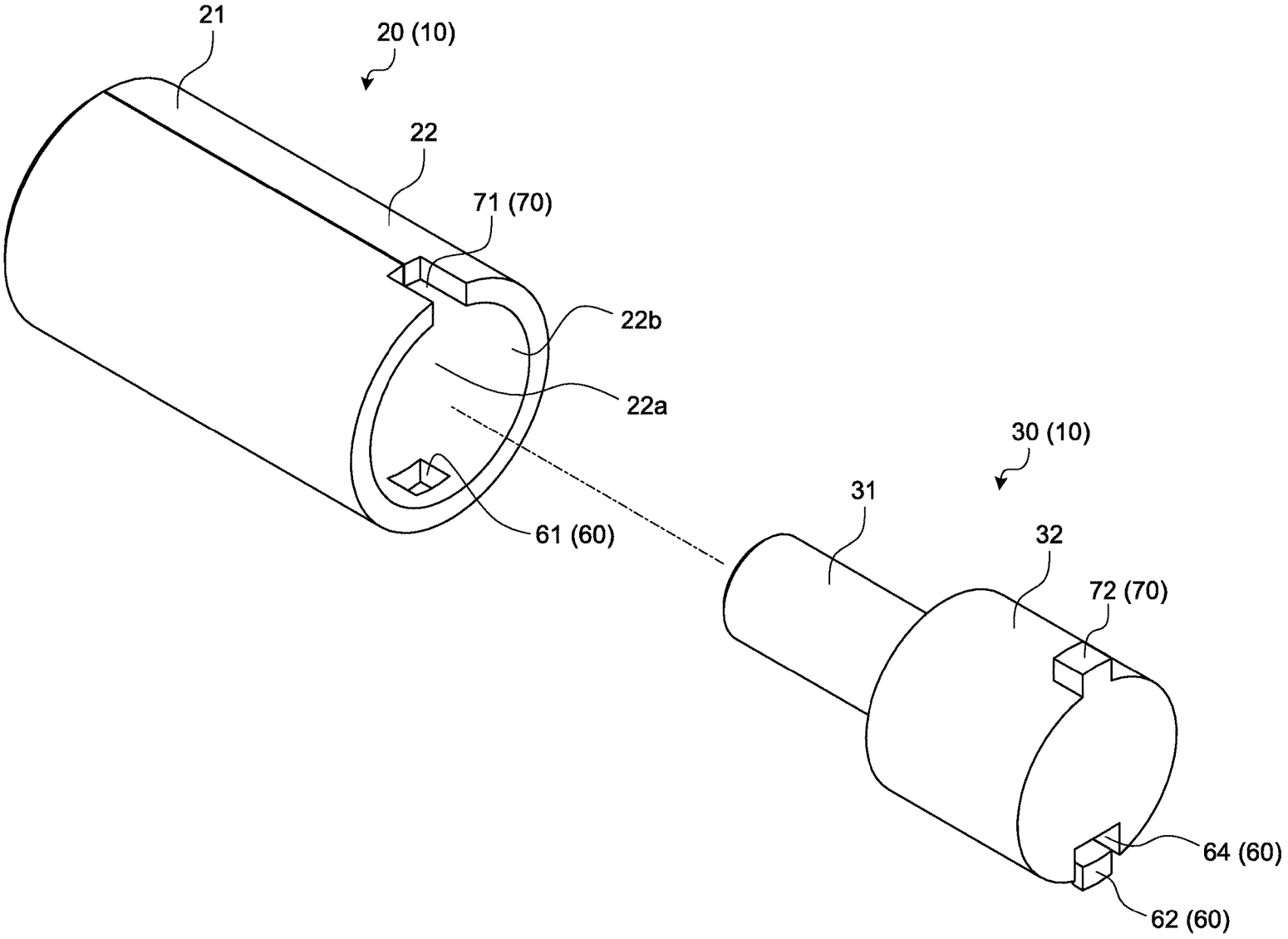
FIG. 11 is an exploded perspective view illustrating the female connector provided with the fixing structure.

More specifically, when the female side connection body 21 and the male side connection body 121 are fitted to each other in an inserting manner, the finger touch prevention body 31 in the example is inserted into a first space portion 131*b* inside an outer tubular body 131, which will be described below, and the male side space portion 121*a*. The finger touch prevention body 31 is inserted into the first space portion 131*b* from the tip end at the connector insertion direction side, and reaches the male side space portion 121*a*. Consequently, to easily insert the finger touch prevention body 31 into the first space portion 131*b*, it is preferable to provide an annular chamfer part 31*a* on the tip end of the finger touch prevention body 31 at the connector insertion direction side over the circumference direction (FIG. 8). The chamfer part 31*a* may have a curved surface or a plain surface. The chamfer part 31*a* in the example is formed in a tapered shape.

For example, the female side insulation member 30 may be integrally molded with the female terminal 20 installed in a mold (for example, insertion molding). The female side insulation member 30 illustrated in the drawings described above is formed by the integral molding.

Alternatively, the female side insulation member 30 may be molded separate from the female terminal 20. The female side insulation member 30 may be assembled with the female terminal 20, by inserting the finger touch prevention body 31 into the female side space portion 21*a* of the female side connection body 21, and inserting the object to be housed 32 into the housing space portion 22*a* of the housing body 22. For example, during the assembly, the object to be housed 32 is fitted into the housing space portion 22*a*. FIG. 9 to FIG. 13 each illustrate the female connector 10 when the object to be housed 32 is fitted into the housing space portion 22*a*. In this example, in the female connector 10, in assembling the separately molded female terminal 20 and the female side insulation member 30, the female side insulation member 30 is inserted into the female terminal 20 from the housing body 22 side. In the housing body 22, an opening at a side opposite to the female side connection body 21 is used as an insertion port 22*b* of the female side insulation member 30 (from FIG. 9 to FIG. 13). The female side insulation member 30 is inserted into the insertion port 22*b* from the finger touch prevention body 31 side.

In assembling the separately molded female terminal 20 and the female side insulation member 30, the female terminal 20 and the female side insulation member 30 are assembled so that the relative positional relation between the female terminal 20 and the female side insulation member 30 will be at an intended housing completion position after the female side insulation member 30 is inserted. The intended housing completion position is a housing position of the female side insulation member 30 relative to the female terminal 20 so as to enable the female side insulation member 30 to carry out the function (at least a hand touch prevention function) required for the female side insulation member 30. To enable such an assembly, in the female connector 10, a fixing structure 60 that fixes the housing body 22 and the object to be housed 32 with each other at the housing completion position may be provided between the housing body 22 and the object to be housed 32 (from FIG. 9 to FIG. 13).

For example, the fixing structure 60 is configured so as to include a first fixing portion 61 provided on the housing body 22 and a second fixing portion 62 provided on the object to be housed 32 (from FIG. 10 to FIG. 13). The fixing structure 60 fixes the housing body 22 and the object to be housed 32 with each other at the housing completion position, by engaging the first fixing portion 61 and the second fixing portion 62 with each other. For example, one of the first fixing portion 61 and the second fixing portion 62 is formed as a fixing projection part projected in a direction orthogonal to the axial direction of the housing body 22 and the object to be housed 32. The other of the first fixing portion 61 and the second fixing portion 62 is formed as a through-hole-shaped or recessed engaging part into which the fixing projection part is inserted and that engages the fixing projection part in the axial direction and the circumference direction of the housing body 22 and the object to be housed 32. In this example, the first fixing portion 61 is formed as the engaging part, and the second fixing portion 62 is formed as the fixing projection part.

Figure 12:
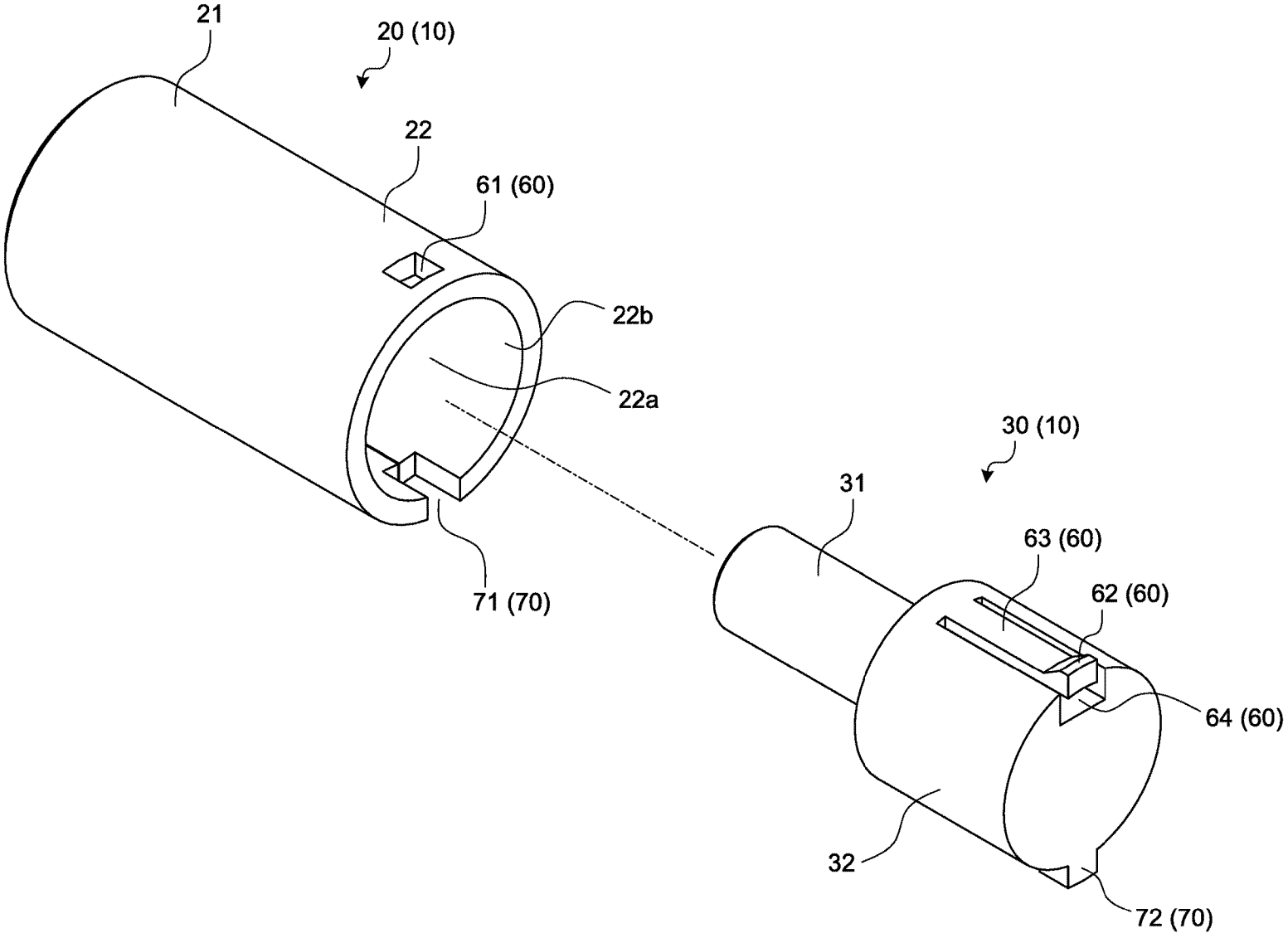
FIG. 12 is an exploded perspective view of the female connector provided with the fixing structure viewed from another angle.
Figure 13:
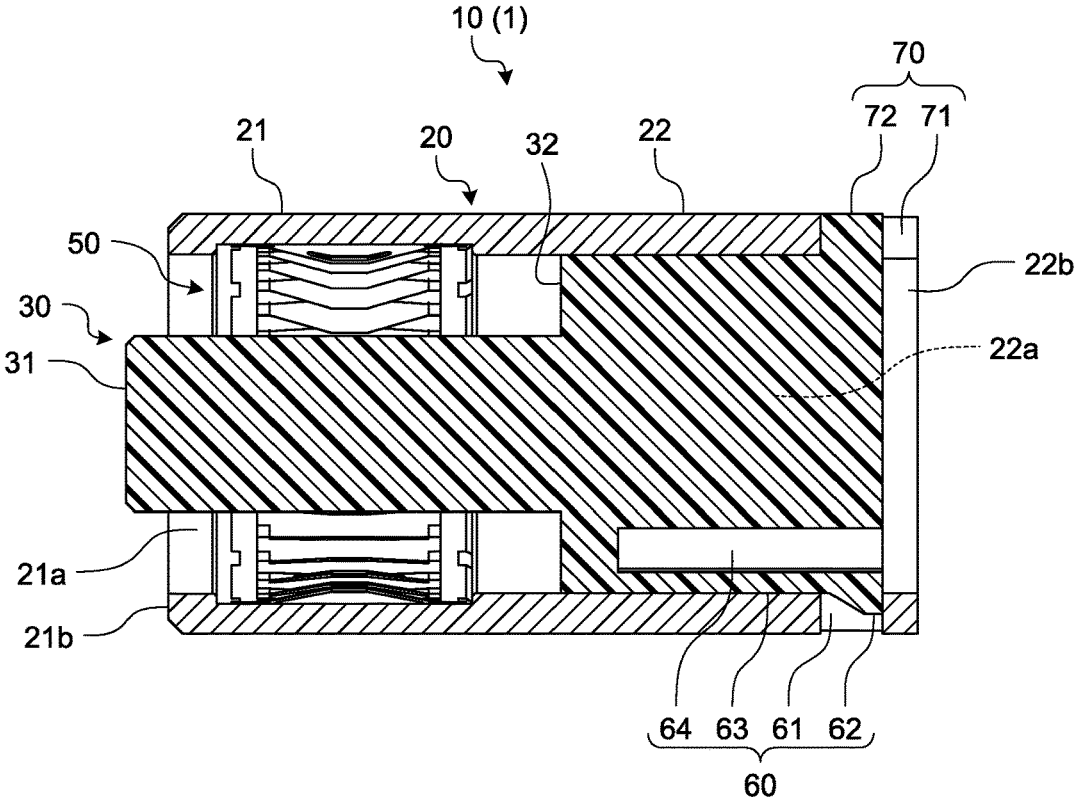
FIG. 13 is a sectional view cut along the line X3-X3 in FIG. 9.

The second fixing portion 62 in the example is provided on a free end of a flexible piece 63 having flexibility (FIG. 12 and FIG. 13). The flexible piece 63 has a fixed end and a free end in the axial direction of the object to be housed 32. The object to be housed 32 has a retraction space 64 into which the second fixing portion 62 is retracted, when the flexible piece 63 is bent inwardly in the radial direction. The second fixing portion 62 is retracted into the retraction space 64 with the bending of the flexible piece 63, while being pushed and moved to the inner peripheral surface of the housing space portion 22*a*. The second fixing portion 62 is inserted into the first fixing portion 61 when the bending of the flexible piece 63 is eliminated at the housing completion position.

In the female connector 10, the female side insulation member 30 is inserted from the insertion port 22*b* of the housing body 22 so that the first fixing portion 61 and the second fixing portion 62 are engaged with each other at the housing completion position. In the fixing structure 60, the first fixing portion 61 serving as the fixing projection part is inserted into the second fixing portion 62 serving as the through-hole-shaped or recessed engaging part, when the female side insulation member 30 reaches the housing completion position.

With the fixing function of the fixing structure 60, in the female connector 10, it is possible to assemble the separately molded female terminal 20 and the female side insulation member 30 so that the relative positional relation of the female terminal 20 and the female side insulation member 30 will be at the intended housing completion position. Consequently, the female connector 10 of the present embodiment is capable of ensuring the hand touch prevention function relative to the female terminal 20. Moreover, in the female connector 10, the female side insulation member 30 can be assembled to the female terminal 20 at the housing completion position. Consequently, the female connector 10 is also capable of ensuring an aligning function, which will be described below. Furthermore, the female connector 10 is capable of keeping the relative positional relation between the female terminal 20 and the female side insulation member 30 by the fixing structure 60. Consequently, the female connector 10 is capable of keeping the hand touch prevention function and the aligning function relative to the female terminal 20, even after the connector is fitted (after the male connector 110 is fitted) or after the connector is separated (after the male connector 110 is taken out).

Still furthermore, in the female connector 10, the separately molded female terminal 20 and the female side insulation member 30 can be assembled so that the relative positional relation between the female terminal 20 and the female side insulation member 30 will be at the intended housing completion position. Consequently, it is possible to improve the assembling workability. Thus, with the female connector 10, for example, it is possible to avoid an incorrect assumption that the assembly of the female terminal 20 and the female side insulation member 30 is finished, before the female side insulation member 30 reaches the housing completion position. Moreover, with the female connector 10, it is possible to avoid the female side insulation member 30 from exceeding the housing completion position and being inserted more deeply.

Figure 14:
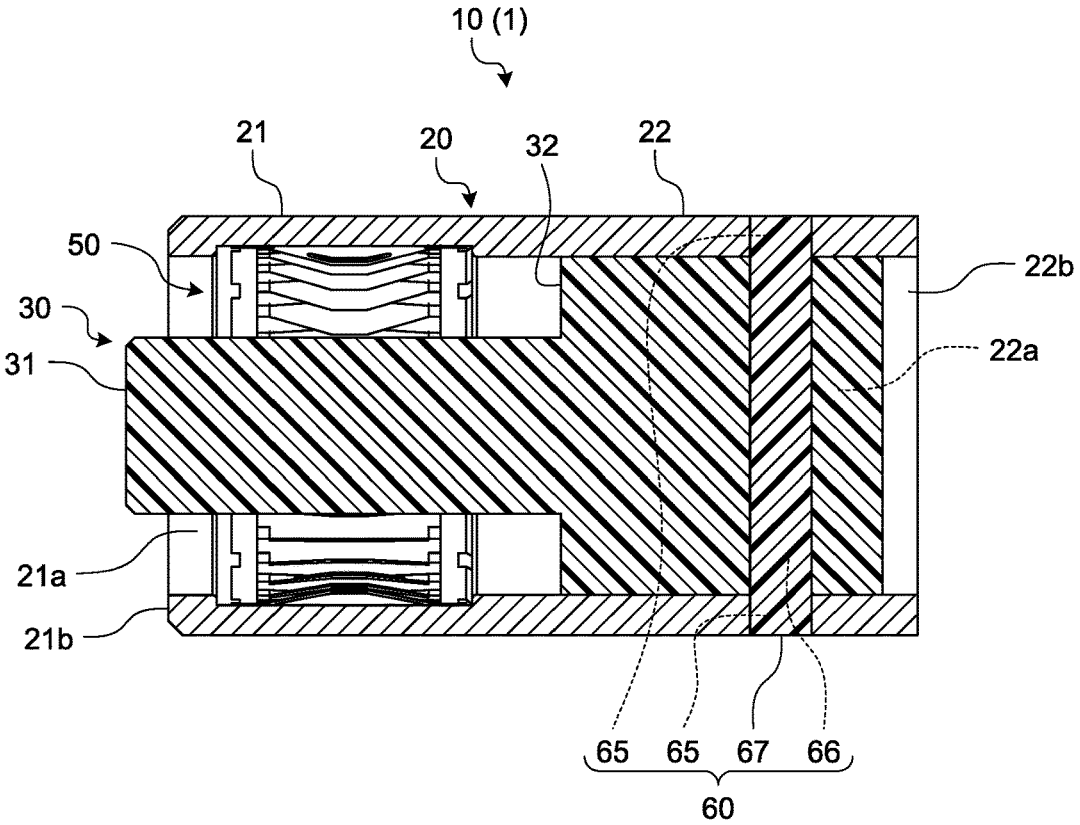
FIG. 14 is a sectional view illustrating a variation of the fixing structure.

Instead of using the fixing structure 60 including the first fixing portion 61 and the second fixing portion 62 described above, the fixing structure 60 having the following structure may also be used. This fixing structure 60 includes a fixing through hole 65, a fixing space portion 66, and a fixing member 67 (FIG. 14). The fixing through hole 65 is provided in the housing body 22. The fixing space portion 66 is provided in the object to be housed 32 and is disposed opposite to the fixing through hole 65 at the housing completion position. The fixing member 67 is fitted to the fixing through hole 65 and the fixing space portion 66 in an inserting manner. For example, two round fixing through holes 65 disposed facing each other in the radial direction with the housing space portion 22*a* interposed therebetween are formed in the housing body 22. Columnar-shaped through holes the openings of which are disposed facing the two fixing through holes 65 are provided as the fixing space portion 66 to the object to be housed 32. The fixing member 67 is molded into a columnar-shaped pin member from an insulation material such as synthetic resin. The fixing member 67 is inserted into one of the fixing through holes 65 from one end, and the fixing member 67 is inserted into the fixing space portion 66 until the end of the fixing member 67 reaches the other fixing through hole 65. The fixing member 67 is fitted to the two fixing through holes 65 and the fixing space portion 66. Even when the structure of the fixing structure 60 is changed as described above, the female connector 10 can obtain the same effects as those of the previous example. In this example, the fixing member 67 is molded from an insulation material such as synthetic resin. However, the fixing member 67 may also be molded into a columnar-shaped pin member from a conductive material such as metal.

In the female connector 10, it is preferable to provide a guide structure 70 between the housing body 22 and the object to be housed 32 (from FIG. 9 to FIG. 13). The guide structure 70 guides the object to be housed 32, which is inserted into the housing body 22 from the insertion port 22*b* of the housing body 22 in the axial direction, to the housing completion position. The guide structure 70 includes a first guide part 71 provided on the housing body 22 and a second guide part 72 provided on the object to be housed 32. For example, one of the first guide part 71 and the second guide part 72 is formed as a guide projection part projecting in a direction orthogonal to the axial direction of the housing body 22 and the object to be housed 32. The other of the first guide part 71 and the second guide part 72 is formed as a guide groove part for guiding the guide projection part to the housing completion position, when the object to be housed 32 is inserted from the insertion port 22*b* in the axial direction. In this example, the first guide part 71 is formed as the guide groove part, and the second guide part 72 is formed as the guide projection part. In this example, the female side connection body 21 and the housing body 22 are formed by bending a rectangular flat plate into a cylindrical shape. Consequently, in this example, two corners of the rectangular flat plate at a side that becomes the housing body 22 after being bent are notched into a rectangular shape. Then, the two rectangular notches are disposed facing each other in the circumference direction after the flat plate is being bent. The first guide part 71 in this example is formed by the two rectangular notches disposed facing each other.

In the female connector 10, the female side insulation member 30 is inserted from the insertion port 22*b* of the housing body 22 so as the first guide part 71 and the second guide part 72 are engaged with each other (in other words, so as the second guide part 72 serving as the guide projection part is inserted into the first guide part 71 serving as the guide groove part). Consequently, in the female connector 10, regardless of the structure of the fixing structure 60, it is possible to easily assemble the separately molded female terminal 20 and the female side insulation member 30 so that the relative positional relation between the female terminal 20 and the female side insulation member 30 will be at the intended housing completion position. Thus, the female connector 10 is capable of further improving the assembling workability of the female terminal 20 and the female side insulation member 30.

In this example, in the female connector 10, an insulating annular body 42 projected more than a tip end surface 21*b* of the female side connection body 21 at the connector insertion direction side on the same cylinder axis is provided outside the female side space portion 21*a* in a direction orthogonal to the tubular axial direction of the female side connection body 21 (FIG. 6 and FIG. 7). In the female connector 10, when the inner diameter of the annular body 42 is smaller than the size of a reference finger, the annular body 42 may carry out a contact prevention function of a finger to the female terminal 20. For example, the reference finger refers to the joint test finger of protection grade IPXXB. However, in the female connector 10 of the present embodiment, a case that the annular body 42 may not be able to prevent a finger from coming into contact with the female terminal 20 with an increase in the physical size in the radial direction is taken into consideration. Consequently, in the female connector 10 of the present embodiment, a finger is prevented from coming into contact with the female terminal 20 by the finger touch prevention body 31 and the annular body 42.

Figure 15:
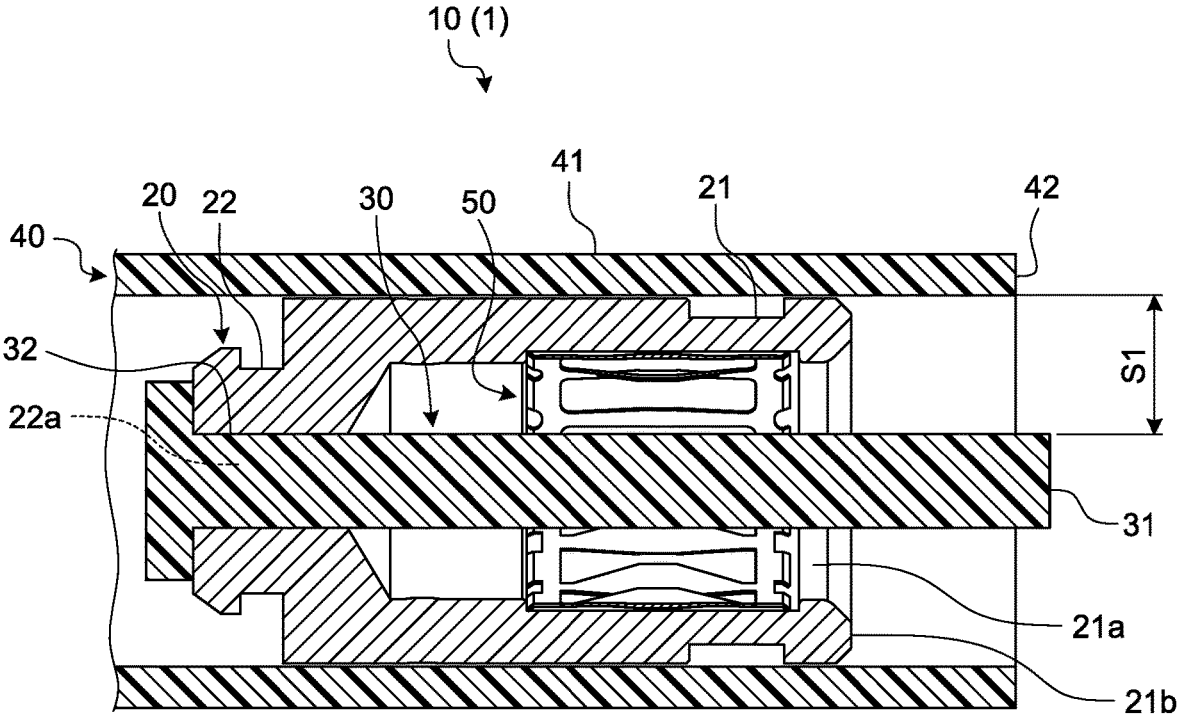
FIG. 15 is a sectional view illustrating a variation of the female connector.

Thus, the finger touch prevention body 31 is projected more than the tip end surface 21*b* of the female side connection body 21 at the connector insertion direction side in the axial direction (FIG. 6 and FIG. 7). The tip end of the finger touch prevention body 31 at the connector insertion direction side is projected more than the tip end surface 21*b*. The female connector 10 is formed so as to prevent a finger from reaching the female terminal 20 by the finger touch prevention body 31 and the annular body 42. Thus, for example, it is possible to prevent a finger from coming into contact with the female terminal 20, even when the physical size of the female connector 10 is increased in the radial direction with an increase in current. In this example, a gap S1 (FIG. 6) between the finger touch prevention body 31 and the annular body 42 in the orthogonal direction (direction orthogonal to the cylinder axis direction of the female side connection body 21) is made smaller than the size of the reference finger. For example, in the female connector 10, the outer diameter of the finger touch prevention body 31 is defined so as to be the gap S1 described above. Moreover, when the outer diameter of the finger touch prevention body 31 is restricted from being increased, the projection amount of the tip end of the finger touch prevention body 31 may be increased so as to prevent a finger from reaching the female terminal 20 by the finger touch prevention body 31 and the annular body 42 (FIG. 15). In this case, the projection amount of the annular body 42 from the tip end surface 21*b* is also increased. For example, the projection amount of the annular body 42 is increased as much as the tip end of the finger touch prevention body 31.

Moreover, in the female connector 10, the tip end of the finger touch prevention body 31 at the connector insertion direction side is projected more than the tip end surface 21*b* of the female side connection body 21. Thus, when the female connector 10 and the male connector 110 are to be fitted in an inserting manner, the tip end of the finger touch prevention body 31 is inserted into the first space portion 131*b* of an outer tubular body 131 in the male side insulation member 130, before the female terminal 20 and the male terminal 120 start fitting in an inserting manner. Consequently, the female connector 10 is provided with the aligning function that is used when the female connector 10 and the male connector 110 are fitted to each other in an inserting manner, by the finger touch prevention body 31 the tip end of which is projected. For example, in the female connector 10, to obtain the aligning function, the tip end of the finger touch prevention body 31 may be projected more than the annular body 42 in the axial direction so that the insertion between the finger touch prevention body 31 and the outer tubular body 131 begins before the insertion between the finger touch prevention body 31 and the other object to be inserted begins. Moreover, for example, in the female connector 10, to obtain the aligning function, the insertion between the finger touch prevention body 31 and the outer tubular body 131, and the insertion between a female side fitting part 41 and a male side fitting part 141, which will be described below, may be started at the same time.

The annular body 42 in this example is provided on the female side fitting part 41, which will be described below, of the female housing 40.

The female housing 40 is molded from an insulation material such as synthetic resin. The tubular-shaped female side fitting part 41 that houses the female terminal 20 therein and that covers the female terminal 20 from outside is formed on the female housing 40 (FIG. 6 and FIG. 7). The female side fitting part 41 is fitted inside the male side fitting part 141, which will be described below, of the male housing 140 in an inserting manner on the same cylinder axis. The annular tip end (end portion at the connector insertion direction side) of the female side fitting part 41 at the connector insertion direction side is used as the annular body 42. Consequently, the tip end of the female side fitting part 41 is projected more than the tip end surface 21*b* of the female side connection body 21 at the connector insertion direction side, in the cylinder axis direction.

Next, the male connector 110 will be described.

In addition to the male terminal 120 and the male side insulation member 130, the male connector 110 includes the male housing 140 that houses the male terminal 120 and the male side insulation member 130 (FIG. 6 and FIG. 7).

The male terminal 120 is molded from a conductive material such as metal. The male terminal 120 includes the tubular-shaped male side connection body 121 fitted to the female side space portion 21*a* of the female side connection body 21 in an inserting manner on the same cylinder axis (from FIG. 5 to FIG. 7). The male side connection body 121 includes the male side space portion 121*a* therein. In this example, the male side connection body 121 is formed in a cylindrical shape.

The male side insulation member 130 is molded from an insulation material such as synthetic resin. The male side insulation member 130 is a member for preventing a finger from coming into contact with the tip end of the male terminal 120 at the connector insertion direction side. The male side insulation member 130 prevents a finger from coming into contact with the male terminal 120 along with the male housing 140. The male side insulation member 130 includes the tubular-shaped outer tubular body 131 that covers an annular tip end surface 121*b* of the male side connection body 121 at the connector insertion direction side on the same cylinder axis (FIG. 1, and from FIG. 5 to FIG. 7). In this example, the outer tubular body 131 is formed in a cylindrical shape.

The outer tubular body 131 is inserted into the female side space portion 21*a* of the female side connection body 21 with the male side connection body 121. Consequently, for example, the outer diameter of the outer tubular body 131 is formed equivalent to the male side connection body 121 so that the insertion operation of the outer tubular body 131 will not be obstructed. To easily insert the outer tubular body 131 into the female side space portion 21*a*, it is preferable to provide an annular chamfer part 131*a* (FIG. 1, FIG. 2, FIG. 5, and FIG. 6) on the tip end of the outer tubular body 131 at the connector insertion direction side over the circumference direction. The chamfer part 131*a* may have a curved surface or a plain surface. The chamfer part 131*a* in the example is formed in a tapered shape.

Moreover, the finger touch prevention body 31 is inserted into the first space portion 131*b* (FIG. 1, and from FIG. 5 to FIG. 7) inside the outer tubular body 131. Consequently, the first space portion 131*b* of the outer tubular body 131 is formed so that the insertion operation will not be obstructed.

As illustrated above, the finger touch prevention body 31 is also inserted into the male side space portion 121*a* of the male side connection body 121. In a conventional fitting connector, the inner diameter of the male side connection body 121 and the inner diameter of the outer tubular body 131 have the same size. Consequently, the finger touch prevention body 31 may come into contact with the male side connection body 121. The fitting connector 1 of the present embodiment is configured so that the finger touch prevention body 31 does not come into contact with the male side connection body 121. In this example, for the sake of convenience of explanation, the same reference numerals denote the same components in the conventional fitting connector as those in the fitting connector 1 of the present embodiment.

Figure 5:
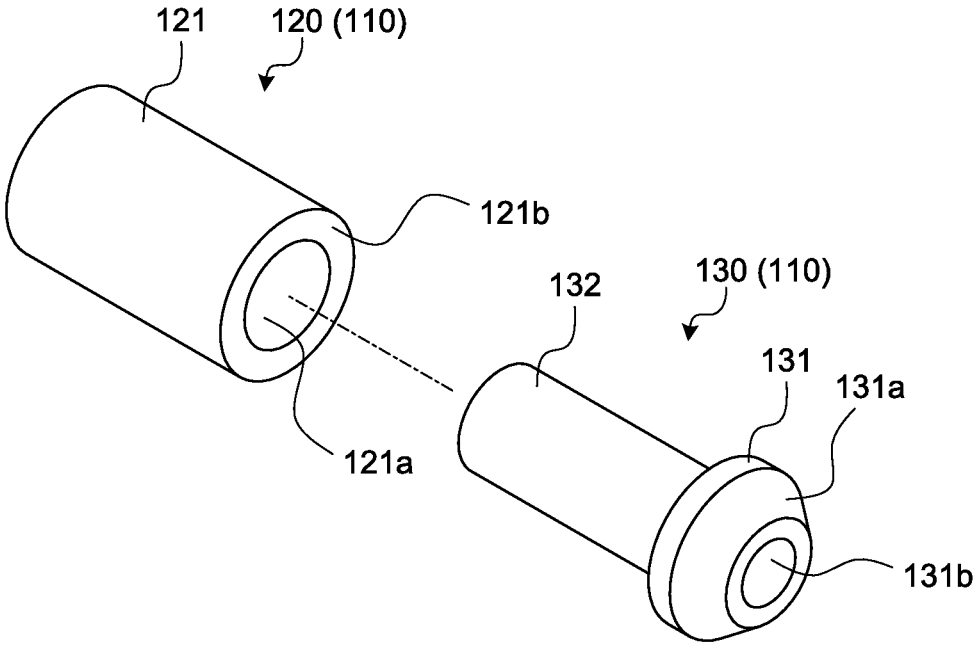
FIG. 5 is an exploded perspective view of a male connector.

In this example, an insulating tubular-shaped inner tubular body 132 is inserted into the male side space portion 121*a* (FIG. 2, and from FIG. 5 to FIG. 7). By interposing the inner tubular body 132 between the finger touch prevention body 31 and the male side connection body 121, the finger touch prevention body 31 is prevented from coming into contact with the male side connection body 121. The inner tubular body 132 is inserted into the male side space portion 121*a* on the same cylinder axis. The finger touch prevention body 31 is inserted into a second space portion 132*a* inside the inner tubular body 132 (FIG. 2, FIG. 6, and FIG. 7), after passing through the first space portion 131*b* of the outer tubular body 131. In this example, the inner tubular body 132 is formed in a cylindrical shape.

In the fitting connector 1, the inner tubular body 132 is interposed between the finger touch prevention body 31 and the male side connection body 121 in this manner. Thus, it is possible to prevent the finger touch prevention body 31 from coming into contact with the male side connection body 121, when the female terminal 20 and the male terminal 120 are inserted or extracted, and when the female terminal 20 and the male terminal 120 are fitted to each other in an inserting manner.

For example, in the conventional fitting connector, when the finger touch prevention body 31 softer than the male side connection body 121 is inserted into the male side space portion 121*a*, and when the finger touch prevention body 31 comes into contact with the corner portion of the male side connection body 121 at the inner peripheral surface side and the outer tubular body 131 side, the finger touch prevention body 31 may be shaved by the corner portion. In the conventional fitting connector, when the shavings of the finger touch prevention body 31 enter between the female terminal 20 and the male terminal 120 by vibration during usage or the like, a conduction failure may occur between the female terminal 20 and the male terminal 120. However, with the fitting connector 1 of the present embodiment, it is possible to suppress the generation of the shavings of the finger touch prevention body 31 such as above, and improve durability of the finger touch prevention body 31. Consequently, the fitting connector 1 of the present embodiment is capable of suppressing reduction in conductive performance between the female terminal 20 and the male terminal 120. Thus, the fitting connector 1 of the present embodiment is capable of keeping the performance as a connector that electrically couples the female and male terminals.

The inner tubular body 132 having the aforementioned functions may be prepared as a different component from the outer tubular body 131. However, to reduce the number of components, or to improve assembling workability, reduce cost, and the like with the reduction in the number of components, it is preferable to integrally form the inner tubular body 132 with the outer tubular body 131. In other words, it is preferable to provide the inner tubular body 132 as a part of the male side insulation member 130. Consequently, in the male side insulation member 130 of the present embodiment, the inner tubular body 132 is projected from the outer tubular body 131 on the same cylinder axis.

For example, the male side insulation member 130 may be integrally molded with the male terminal 120 installed in the mold (for example, insertion molding). Moreover, the male side insulation member 130 may be molded separate from the male terminal 120, and assembled onto the male terminal 120, by inserting the inner tubular body 132 into the male side space portion 121*a* of the male side connection body 121. For example, during the assembly, the inner tubular body 132 is fitted to the male side space portion 121*a*.

Moreover, it is preferable to set the length of the inner tubular body 132 in the cylinder axis direction such that the tip end of the finger touch prevention body 31 at the connector insertion direction side is disposed inside the second space portion 132*a*, when the female side connection body 21 and the male side connection body 121 are fitted to each other in an inserting manner. Consequently, even when the inner tubular body 132 is prepared as a different component from the male side insulation member 130, or even when the inner tubular body 132 is prepared as a part of the male side insulation member 130, the fitting connector 1 is capable of suppressing vibration at the tip end of the finger touch prevention body 31. Consequently, the fitting connector 1 is capable of improving the contact inhibition effect between the finger touch prevention body 31 and the male side connection body 121.

In the male connector 110, an insulating annular body 142 is provided on the same cylinder axis as that of the outer tubular body 131, outside the outer tubular body 131 in a direction orthogonal to the cylinder axis direction of the outer tubular body 131 at an interval (FIG. 6 and FIG. 7). The male connector 110 is configured so as to prevent a finger from coming into contact with the male terminal 120, by the outer tubular body 131 and the annular body 142. In this example, a finger is prevented from coming into contact with the male terminal 120, by making a gap (a gap in a direction orthogonal to the cylinder axis direction) S2 (FIG. 6) between the outer tubular body 131 and the annular body 142 smaller than the size of the reference finger. For example, the reference finger refers to the joint test finger of protection grade IPXXB described above.

The annular body 142 in the example is provided on a male side fitting part 141, which will be described below, of the male housing 140.

The male housing 140 is molded from an insulation material such as synthetic resin. The tubular-shaped male side fitting part 141 that houses the male terminal 120 therein and that covers the male terminal 120 from outside at an interval is formed on the male housing 140 (FIG. 6 and FIG. 7). In the male connector 110, a tubular-shaped space portion is formed between the male terminal 120 and the male side fitting part 141. The female side connection body 21 of the female terminal 20 and the female side fitting part 41 of the female housing 40 are inserted into the tubular-shaped space portion on the same cylinder axis. In the male side fitting part 141, an annular tip end at the connector insertion direction side (end portion at the connector insertion direction side) is used as the annular body 142. Consequently, the male side fitting part 141 is projected more than the tip end surface 121*b* of the male side connection body 121 at the connector insertion direction side in the cylinder axis direction.

As described above, the fitting connector 1 of the present embodiment is capable of preventing a finger from coming into contact with the female terminal 20 and the male terminal 120. For example, regardless of the physical size in the radial direction, the female connector 10 of the present embodiment is capable of preventing a finger from coming into contact with the female terminal 20, by the finger touch prevention body 31 and the annular body 42 that are projecting more than the tip end surface 21*b* of the female side connection body 21. Moreover, in the female connector 10 of the present embodiment, the fixing structure 60 is provided between the housing body 22 of the female terminal 20 and the object to be housed 32 of the female side insulation member 30. Consequently, even when the female terminal 20 and the female side insulation member 30 are molded as separate members, the female connector 10 of the present embodiment is capable of assembling the female terminal 20 and the female side insulation member 30 so that the relative positional relation between the female terminal 20 and the female side insulation member 30 will be at the intended housing completion position. Thus, the female connector 10 is capable of ensuring the hand touch prevention function relative to the female terminal 20.

Moreover, the fitting connector 1 of the present embodiment is capable of preventing a finger from coming into contact with the female terminal 20 and the male terminal 120. The fitting connector 1 of the present embodiment is also capable of suppressing reduction in the conductive performance between the female terminal 20 and the male terminal 120, by the contact prevention function between the finger touch prevention body 31 and the male side connection body 121 using the inner tubular body 132, while ensuring the hand touch prevention function.

Furthermore, the female connector 10 of the present embodiment is capable of obtaining the aligning function that is used when the female connector 10 and the male connector 110 are fitted to each other in an inserting manner, by the finger touch prevention body 31, while ensuring the hand touch prevention function relative to the female terminal 20. In other words, in the female connector 10, the finger touch prevention body 31 has the hand touch prevention function relative to the female terminal 20, and the aligning function used when the connectors are fitted. The aligning function becomes more effective by projecting the tip end of the finger touch prevention body 31 more than the tip end surface 21*b* of the female side connection body 21. Moreover, the aligning function becomes more effective with the effect exerted by the fixing function of the fixing structure 60. Because the fitting connector 1 of the present embodiment includes the female connector 10, the fitting connector 1 can obtain the effects produced by the female connector 10.

Still furthermore, in the female connector 10 of the present embodiment, the fixing structure 60 is provided between the housing body 22 of the female terminal 20 and the object to be housed 32 of the female side insulation member 30. Consequently, even when the female terminal 20 and the female side insulation member 30 are molded as separate members, the female connector 10 of the present embodiment is capable of improving the assembling workability of the female terminal 20 and the female side insulation member 30. Because the fitting connector 1 of the present embodiment includes the female connector 10, the fitting connector 1 can obtain the effects produced by the female connector 10.

Regardless of the physical size in the radial direction, the female connector according to the present embodiment is capable of preventing a finger from coming into contact with the female terminal, by the finger touch prevention body and the annular body that are projecting more than the tip end surface of the female side connection body. Because the fitting connector according to the present embodiment includes the female connector, the fitting connector according to the present embodiment can obtain the effects produced by the female connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A female connector, comprising:

a female terminal physically and electrically connected to a male terminal, including a tubular-shaped male side connection body, of a male connector that is provided with the male terminal and an insulating male side insulation member having a tubular-shaped outer tubular body covering a tip end surface of the male side connection body at a connector insertion direction side on a same cylinder axis; and an insulating female side insulation member, wherein the female terminal includes a tubular-shaped female side connection body having a female side space portion therein into which the male side connection body is fitted in an inserting manner on a same cylinder axis, the female side insulation member includes a pillar-shaped or tubular-shaped finger touch prevention body that is disposed in the female side space portion on a same axial line as that of a cylinder axis of the female side space portion, and that is inserted into a space portion inside the outer tubular body and a male side space portion inside the male side connection body, when the female side connection body and the male side connection body are fitted to each other in an inserting manner, the finger touch prevention body is projected more than a tip end surface of the female side connection body at a connector insertion direction side, in an axial direction, and an insulating annular body projected more than the tip end surface of the female side connection body on a same cylinder axis is provided outside the female side space portion in a direction orthogonal to a cylinder axis direction of the female side connection body.

2. The female connector according to claim 1, further comprising:

a female housing formed with a tubular-shaped female side fitting part that houses the female terminal therein and that covers the female terminal from outside, wherein the annular body is provided on the female side fitting part.

3. The female connector according to claim 1, wherein a tip end of the finger touch prevention body has an annular chamfer part at a connector insertion direction side over a circumferential direction.

4. The female connector according to claim 2, wherein a tip end of the finger touch prevention body has an annular chamfer part at a connector insertion direction side over a circumferential direction.

5. A fitting connector, comprising:

a female connector provided with a female terminal and an insulating female side insulation member; and a male connector provided with a male terminal and an insulating male side insulation member, wherein the female terminal includes a tubular-shaped female side connection body in which a female side space portion is formed, the male terminal includes a tubular-shaped male side connection body fitted to the female side space portion in an inserting manner on a same cylinder axis, the male side insulation member includes a tubular-shaped outer tubular body that covers a tip end surface of the male side connection body at a connector insertion direction side on a same cylinder axis, the female side insulation member includes a pillar-shaped or tubular-shaped finger touch prevention body that is disposed in the female side space portion on a same axial line as that of a cylinder axis of the female side space portion, and that is inserted into a space portion inside the outer tubular body and a male side space portion inside the male side connection body, when the female side connection body and the male side connection body are fitted to each other in an inserting manner, the finger touch prevention body is projected more than a tip end surface of the female side connection body at a connector insertion direction side, in an axial direction, and in the female connector, an insulating annular body projected more than the tip end surface of the female side connection body on a same cylinder axis is provided outside the female side space portion in a direction orthogonal to a cylinder axis direction of the female side connection body.

* * * * *